US006905318B2

(12) United States Patent
Kouno et al.

(10) Patent No.: US 6,905,318 B2
(45) Date of Patent: Jun. 14, 2005

(54) COMPRESSOR INCLUDING TAPERED DISCHARGED VALVE AND VALVE SEAT

(75) Inventors: Takeshi Kouno, Ushiku (JP); Hirokatsu Kohsokabe, Minori (JP); Isao Hayase, Tsuchiura (JP); Kenichi Oshima, Iwafune (JP); Akihiko Ishiyama, Oohira (JP)

(73) Assignee: Hitachi, Ltd., Tokyo (JP)

( * ) Notice: Subject to any disclaimer, the term of this patent is extended or adjusted under 35 U.S.C. 154(b) by 183 days.

(21) Appl. No.: 09/911,614

(22) Filed: Jul. 25, 2001

(65) Prior Publication Data

US 2002/0012595 A1 Jan. 31, 2002

(30) Foreign Application Priority Data

Jul. 26, 2000 (JP) ..... 2000-231355

(51) Int. Cl.[7] ..... F04B 39/10
(52) U.S. Cl. ..... 417/559; 137/540
(58) Field of Search ..... 417/559, 568, 417/415; 137/543.17, 540; 251/333

(56) References Cited

U.S. PATENT DOCUMENTS 4,329,125 A * 5/1982 Chambers ..... 417/569
4,368,755 A * 1/1983 King ..... 137/512.3
4,445,534 A * 5/1984 King ..... 137/512.3
4,543,989 A * 10/1985 Lorson ..... 137/543.19
5,080,130 A * 1/1992 Terwilliger et al. ..... 137/512
5,346,373 A * 9/1994 Riffe ..... 417/415
5,897,305 A * 4/1999 Roddis ..... 417/566
6,132,191 A * 10/2000 Hugenroth et al. ..... 418/55.1

FOREIGN PATENT DOCUMENTS

JP 8319973 12/1996
JP 8-319973 * 12/1996

* cited by examiner

*Primary Examiner*—Charles G Freay
(74) *Attorney, Agent, or Firm*—Antonelli, Terry, Stout & Kraus, LLP

(57) ABSTRACT

A compressor includes a compression chamber for compressing working fluid within an inside thereof, a discharge port, through which the working fluid flows out from the compression chamber, and a discharge valve for opening or closing the discharge port. The discharge valve includes a valve seat portion provided in the discharge port and having a tapered surface, so that a cross-section area of the discharge port comes to be large from a side of the compression chamber. The valve has a projection portion having a tapered surface in contact with the tapered surface of the valve seat portion. A spring is provided on a member formed in one body with the valve seat portion, for positioning the valve to the valve seat portion, wherein clearance volume of the discharge port is reduced, so as to improve the performances thereof.

13 Claims, 19 Drawing Sheets

COMPRESSOR INCLUDING TAPERED DISCHARGED VALVE AND VALVE SEAT

BACKGROUND OF THE INVENTION

The present invention relates to a compressor for use, mainly, in a cooling, refrigeration and/or air-conditioning apparatuses.

Conventionally, as a valve for opening and/or closing a passage, through which coolant or refrigerant flows into and/or out in a reciprocating compressor and/or a rotary compressor for use in cooling, refrigeration and/or air-condition, in particular, the valve which is applied into a discharge port for discharging the refrigerant therefrom, it is common to use a valve of so-called a reed-type, in which a thin plate-like valve opens and/or close the port therewith.

With such the valve mentioned above, an end of the plate-like valve is disposed so that it closes an outlet portion of the discharge valve, through which the refrigerant flows out, while the other end thereof is fixed on a side of compressing element of the compressor (i.e., on the port side thereof), wherein the opening/closing of the valve is conducted automatically through pressure difference between an inside and an outside of the discharge port. Also, there is one, in which the valve is fixed onto the compressing element through a stopper.

Considering an improvement on performances of the compressor, working fluid (i.e., the refrigerant) lying within the volume of a part of the discharge port, i.e., a gap or clearance volume, will not be discharged when the compressor completes the discharge cycle or stroke thereof, therefore it remains therein. Namely, the refrigerant remaining in this part comes to be discharged by the compressor operation but does not effect the heat exchange, therefore an efficiency in the compressor operation is lowered down if such the refrigerant increases in the volume thereof.

The working fluid of high temperature and high pressure remaining in this clearance volume, after all, expands within a suction chamber of low pressure, and in particular, in a case of the reciprocating compressor, this expansion reduces the suction volume thereof, thereby bringing about the decreasing of volume efficiency. Also, since energy of this expansion cannot be recovered or collected in the case of the rotary compressor, it comes to be power loss (hereinafter, being called by "re-expansion loss"), therefore it brings about lowering of the performances in the compressor. The greater the loss due to this re-expansion loss, the larger the ratio of the clearance volume occupying within the stroke volume of the compressor. For example, according to studies made by the inventors of the present invention, it is found that adiabatic efficiency is reduced down by about 5% due to this re-expansion, in particular in the case of the rotary compressor that is used in a home-use refrigerator.

For dissolving such the problem of the reed valve, for example, U.S. Pat. Nos. 4,543,989 and 5,346,373 disclose discharge valve apparatuses, in which a discharge valve of a poppet-type is applied so as to bring the clearance volume to be almost zero (0).

In the above-mentioned U.S. Pat. No. 4,543,989 (prior art 1) is disclosed a compressor of the reciprocating-type, which comprises a discharge port having a valve of a conical-shape and a spherical shape, and a valve seat recessed in a conical-shape, wherein the valve bodies are engaged within the recess of the valve seat, so as to remove that clearance volume therein. With the structure according to this prior art, the valve and the valve seat, both in the conical shape, are in contact with each other upon contacting surfaces thereof, thereby enclosing the spaces in front and rear of the port. Further, the valve is restricted on displacement in the vertical direction and decentering in the horizontal direction, within a cylindrical vacant cavity of a retainer engaged with or fitted to a bridge member, being provided over an opening of the port, so that it cover the discharge port on a downstream side thereof, and the valve is biased toward the valve seat by means of a wound leaf spring which is inserted into this cavity.

Further in the above-mentioned Pat. No. 5,346,373 (prior art 2), a discharge valve apparatus is disclosed, in which both the valve and the valve seat are formed in the spherical shapes, so that they enable to close up even if the valve are inclined to the valve seat, and further the valve is biased toward the valve seat by means of the thin plate-like spring.

In the above-mentioned prior art 1, the retainer is fixed onto the compressing element (a cylinder side) by screwing the bridge member, on which is engaged or fitted the retainer, however when the retainer is attached onto the valve seat in eccentric or decentering therefrom, i.e., in a case where the valve is assembled into the valve seat in decentering therefrom, the valve declines when seating, so that it is unable to fully contact with upon the surface thereof, thereby disabling the enclosure, and therefore the working liquid of high temperature and high pressure flows back into the suction chamber, thereby decreasing volume efficiency. For this reason, the retainer and the valve seat must be fixed in concentric with each other, at high accuracy, therefore it causes a problem that the number of processes in assembling increases up, as well as the cost thereof. Further, the discharge valve apparatus is large in the number of constituent parts and complex in the structure thereof, therefore the productivity thereof is decreased down.

Also, though it is easy for a large compressor, it is more difficult to make an adjustment on the compressor, if it comes to be smaller in the sizes thereof, and also the higher accuracy is needed for it, therefore it causes a problem of bringing about the cost-up, however this prior art never pay considerations onto such the problems.

Also, in this prior art, since the valve is pushed or projected into the operation chamber of the compressor, so that it collides on a piston, if a bottom surface of the valve lies on the same plane to that of a valve plate and if the valve declines, during the closure of the valve, there occurs a problem that both collide with each other, in particular in the case of the rotary compressor, in which the moving direction of the valve for opening/closing, as well as that of a roller thereof, lie in the vertical direction. No consideration was paid, however, on those problems in this prior art.

In the prior art 2 mentioned above, since no bias is applied onto the valve due to the spring force under the condition when the valve is closed, and further no means is provided for restricting the movement of the valve in the horizontal direction, a delay is caused in the closing operation thereof due to rebounding when the valve is seated on the valve seat and/or the inclination of the valve when it is seated in greatly eccentric or decentering to the valve seat, therefore it causes a problem that the working fluid of high temperature and high pressure flows back into the suction chamber, thereby decreasing the volume efficiency down.

Also, with the retainer, the spring and the valve, etc., the constituent parts of the discharge valve apparatus, since they must be treated separately when they are assembled, it is difficult to handle or deal with them if they become small in sizes thereof, for example, in case of being applied into the compressor of small capacity, such as the compressor of a refrigerator or an air-conditioner for home-use, thereby bringing about a problem of decreasing down workability in assembling, as well as the productivity thereof.

Also, since the valve projects into the operation chamber of the compressor while providing a gap or clearance for escaping at the top portion of the piston, the clearance volume comes to be large, and this cannot be applied to such the rotary compressor, in which the moving direction of the valve for opening/closing, as well as that of the roller thereof, lie in the vertical direction. No consideration was paid, however, on such the problem in this prior art 2.

SUMMARY OF THE INVENTION

An object according to the present invention, therefore, is to provide a compressor, which can be assembled with ease, improving compression efficiency or adiabatic efficiency, as well as performances thereof.

The object mentioned above, according to the present invention, is accomplished by a compressor, comprising: a compression chamber for compressing working fluid within an inside thereof; a discharge port, through which said working fluid flows out from said compression chamber; a valve means for opening or closing said discharge port; a valve seat portion being provided in said discharge port and having a shape of curved surfaces, so that a cross-section area of said discharge port comes to be large from a side of the compression chamber; a valve having a projection portion having a curved surface in contact with said curved surface of the valve seat portion; and a means being provided on a member formed in one body with said valve seat portion, for positioning said valve to said valve seat portion.

Or alternatively, it is also accomplished by a compressor, comprising: a compression chamber for compressing working fluid within an inside thereof; a discharge port, through which said working fluid flows out from said compression chamber; a valve means for opening or closing said discharge port; a valve seat portion being provided in said discharge port and having a shape of curved surfaces, so that a cross-section area of said discharge port comes to be large from a side of the compression chamber; a valve having a projection portion having a curved surface in contact with said curved surface of the valve seat portion; a bore being provided on a member formed in one body with said valve seat portion, and connecting to said valve seat portion; and a holding means being inserted into an inside of said bore to be positioned, for holding said valve opposing to said valve seat.

Further, it is also accomplished by the compressor as defined in the above, further comprising: a biasing means for supporting said valve, so that said valve is freely contact on or separate from a sheet surface of said valve seat portion. Furthermore, it is also accomplished by the compressor as defined in the above, wherein said biasing means is a coiled spring, which is engaged with said valve and formed nearly into a conical shape. Or alternatively, it is also accomplished with the compressor as defined in the above, wherein said biasing means is a leaf spring, being formed with slits therein and biasing said valve with a central portion thereof.

DETAILED DESCRIPTION OF THE PREFERRED EMBODIMENTS

Hereinafter, embodiments according to the present invention will be fully explained by referring to the attached drawings.

Figure 1A:
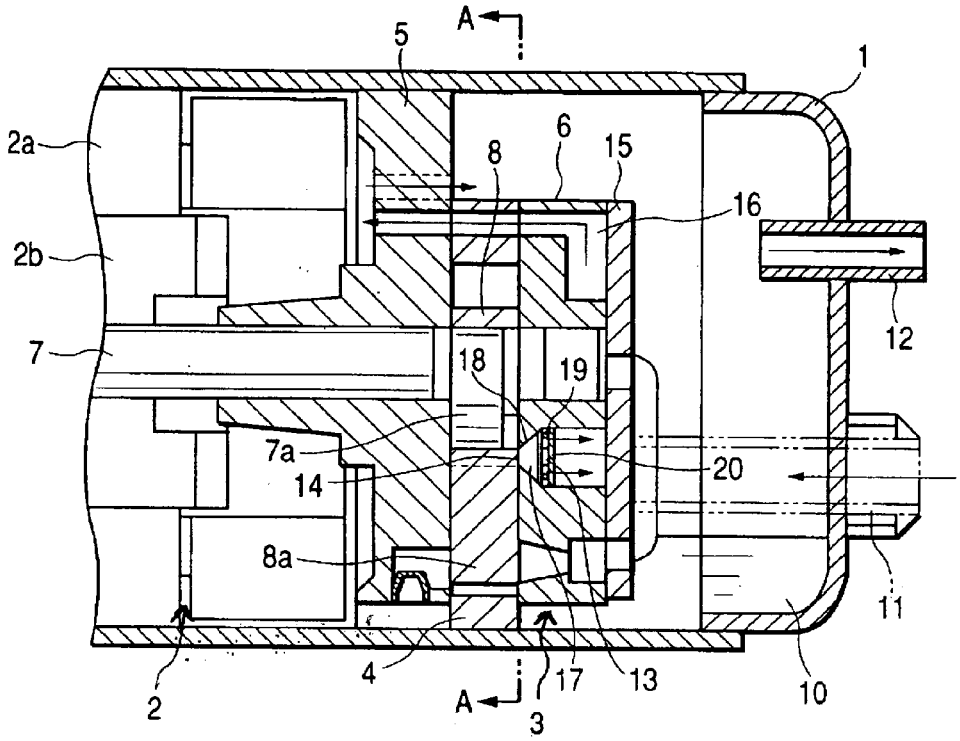
FIGS. 1(*a*) and 1(*b*) are the vertical and the horizontal cross-section views of a portion of a compressor according to the present invention.
Figure 1B:
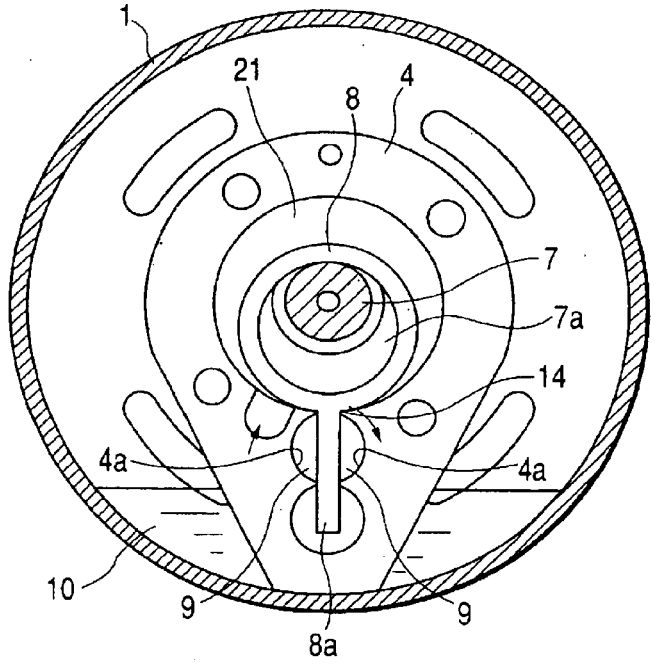
Figure 2:
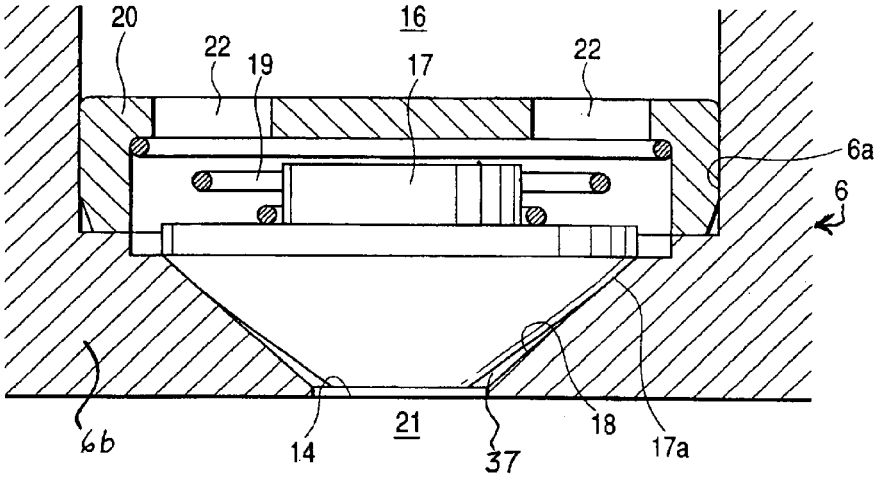
FIG. 2 is an enlarged view of the compressor which is shown in the FIGS. 1(*a*) and 1(*b*), in particular for explaining a condition where a discharge valve thereof is closed.
Figure 3:
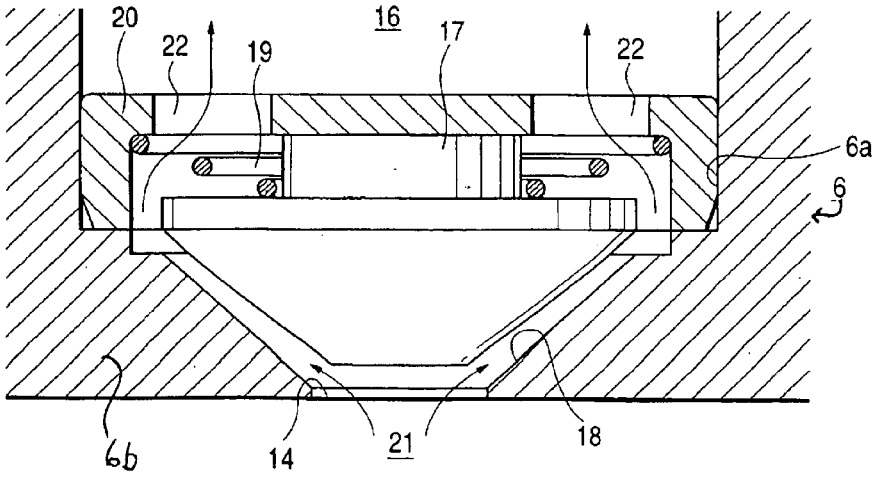
FIG. 3 is an enlarged view of the compressor which is shown in the FIGS. 1(*a*) and 1(*b*), in particular for explaining a condition where a discharge valve thereof is opened.
Figure 4:
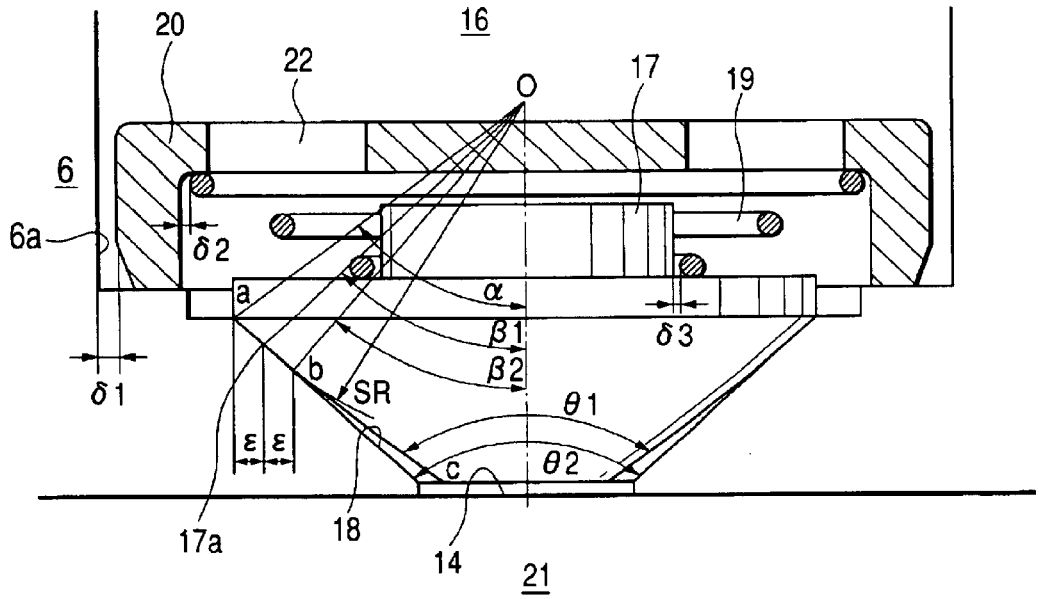
FIG. 4 is an enlarged view of the compressor which is shown in the FIGS. 1(*a*) and 1(*b*), in particular for explaining curved surface configure of a valve of the discharge valve thereof.
Figure 5:
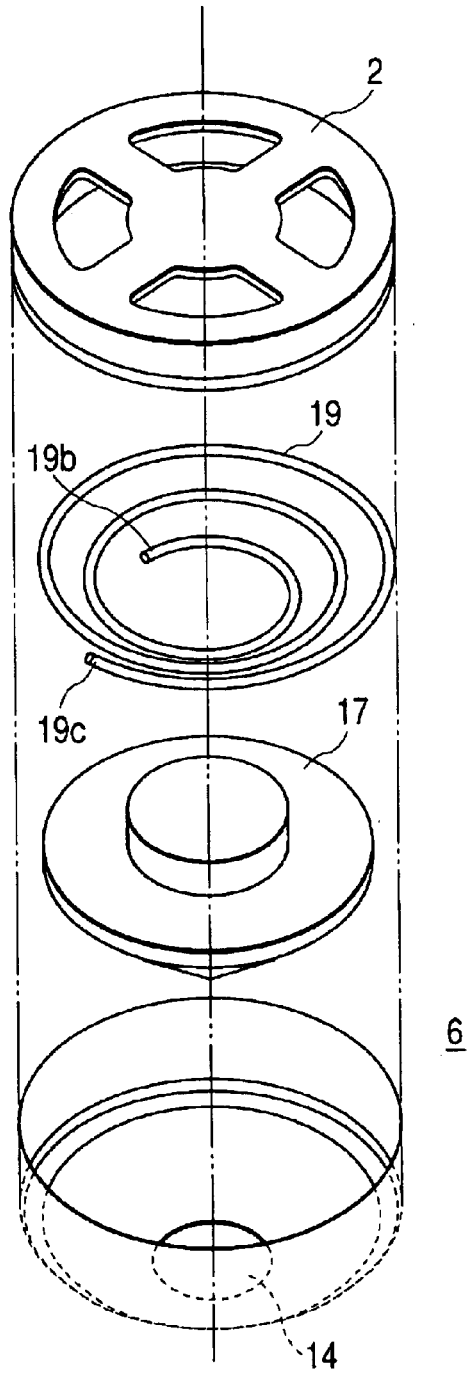
FIG. 5 is an exploded perspective view of parts which constitute the discharge valve of the compressor shown in the FIGS. 1(*a*) and 1(*b*)

FIG. 1(*a*) is the vertical cross-section view for showing the structure of a horizontal-type oscillating piston compressor, as one embodiment of the compressor comprising a discharge valve according to the present invention, and FIG. 1(*b*) the horizontal cross-section view corresponding to a A—A cross-section in the FIG. 1(*a*). FIGS. 2 and 3 are enlarged views of the discharge valve shown in the FIGS. 1(*a*) and 1(*b*), and in particular, the FIG. 2 shows the condition where the discharge valve is closed, while the FIG. 3 where the discharge valve is fully opened. FIG. 4 is an enlarged view of the compressor shown in the FIGS. 1(*a*) and 1(*b*), for explaining curved surface configure of a valve of the discharge valve thereof. FIG. 5 is an exploded perspective view of parts which constitute the discharge valve of the compressor shown in the FIGS. 1(*a*) and 1(*b*). And, FIGS. 6(*a*) through 6(*c*) are views for explaining an assembling method of the discharge valve of the compressor shown in the FIGS. 1(*a*) and 1(*b*).

First of all, explanation will be given by referring to the FIGS. 1(*a*) through 3.

A reference numeral 1 indicates a hermetic container, in which are stored an electromotive element (i.e., a motor) 2 having a stator 2*a* and a rotor 2*b*, and a compression element 3 driven by that electromotive element 2. The compression element 3 comprises a cylinder 4, a main bearing 5 and a sub- or auxiliary bearing 6 blocking the cylinder 4 at both end openings thereof, and a retainer insertion portion 6*a* formed in the sub-bearing 6. This retainer insertion portion or bore 6*a*, as will be mentioned later, constitutes a portion, into which is inserted a retainer for positioning a discharge valve of the compressor to a discharge port.

It further comprises an oscillating piston 8, which is rotatably engaged with an eccentric portion 7*a* of a crank shaft 7 connected to the electromotive element 2 mentioned above, and a shoe 9 having a plane portion slidably abutting on a vane portion 8*a* of the oscillating piston 8 and a cylindrical surface portion slidably abutting on a cylindrical opening portion 4*a* of the cylinder 4 mentioned above. A reference numeral 10 indicates lubrication oil stored on the bottom of the hermetic container, 11 a suction pipe, through which refrigerant is sucked into, 12 a discharge pipe through which the refrigerant is discharged, 13 a discharge valve disposed on an end plate 6*b* of the sub-bearing 6, 14 a discharge port, and 15 a discharge cover for defining a discharge chamber therewith.

Also, the discharge valve 13 is constructed from a valve 17, a valve seat 18, a coiled spring 19 for biasing the valve 17 toward the valve seat 18, and a retainer 20 for restricting the valve 17 from displacement thereof and positioning the valve to the valve seat or the discharge port. The valve 17 is made of a heat-resistive synthetic resin, such as, polyimide, polyamideimide, polyether-etherketone, polyetherimide, etc., or alloy material of relatively light-weight, such as, an alloy of titanium group, etc., and has a seal portion 17*a* in a spherical shape, so that it enters into inside of the discharge port 14, to contact the valve seat 18 on the surface thereof, thereby closing or blocking the discharge port 14.

The valve seat 18 is formed around the discharge port 14 in one body, and has an almost conical and trapezoidal shape. Also, the coiled spring 19 is made from a line-like material (wire) of same diameter, and is formed, for example, in a conical shape, and/or wound at an equal pitch, so that the line-like material does not contact with by itself even when the coiled spring 19 is compressed.

In the example of this embodiment, the oscillating piston compressor performs the compression operation as below. Upon rotation of the rotor 2*b* of the electromotive element 2, the crank shaft 7 is driven, and the oscillating piston 8 engaged with the eccentric portion 7*a* on the crank shaft 7 performs wobbling movement within the cylinder 4. An operation chamber 21 defined within the cylinder 4 is divided into a suction chamber and a compression chamber by the vane portion 8*a*, therefore working fluid sucked from the suction pipe 11 into the suction chamber is compressed in the compression chamber. The compressed working fluid (i.e., the refrigerant) enters into the discharge chamber 16 from the discharge port 14 through the discharge valve 13, and thereafter is discharged within the hermetic container 1, to be discharged into an outside therefrom.

Next, explanation will be given on the operation of the discharge valve 13 according to the present embodiment. FIG. 2 shows the condition where the discharge valve is closed, i.e., the condition of the discharge valve on suction stroke and on compression stroke. In this instance, the discharge chamber 16 in an upper portion of the valve 17 is communicated with, therefore it is filled with an atmosphere of the refrigerant discharged, i.e., at the high pressure of the discharge gas. On a while, since the discharge port 14 is communicated with the working chamber 21 on the suction stroke and/or the compression stroke, the pressure therein is lower than the discharge pressure at a lower portion of the valve 17.

Accordingly, force acts upon the valve 17 due to the difference in pressures between those two, so that the valve 17 is suppressed downward. With this force, the seal portion 17*a* having the curved-surface shape of the valve 17 is pushed down toward the valve seat 18, and they form a line-like contact portion forming just a circuit shape or the like, i.e., forming a so-called line contact, thereby maintaining the sealing therebetween.

The pressure increases up within the operation chamber 21 as the compression stroke proceeds, and when it comes to be larger than the discharge pressure, the force acting upon the valve 17 then pushes it down toward an outlet side (an upper side in the figure) of the discharge port due to the pressure difference. Explanation will be given on this condition by referring to FIG. 3.

With the force due to the pressure difference in the refrigerant (i.e., the working fluid), the valve 17 is pushed up towards the outlet side (the upper side) of the discharge port as shown in the FIG. 3, and in this instance, a gap or clearance occurs between the valve 17 and the valve seat 18. The working fluid compressed within the operation chamber 21 is discharged from the discharge port 14 after passing through the clearance mentioned above, a space defined between the line of the coiled spring 19 and a discharge gas passage 22 defined in the retainer 20 into the discharge chamber 16. Namely, the insertion portion 6*a*, into which the retainer is inserted, forms a part of the discharge port or the discharge passage for the working fluid.

The retainer 20 restricts the position of the valve 17, so that the surface of the retainer 20 on the valve 17 side abuts on the surface of the valve 17 on the retainer 20 side, under the condition where the valve 17 is pushed upwards and then the coiled spring 19 is compressed. When the discharge stroke is completed, the valve 17 is pushed back by means of elastic force of the coiled spring 19, so as to be seated on the valve seat 18, i.e., in the condition shown in the FIG. 2, where the discharge valve is closed, again.

Next, explanation will be given on the configuration of curved surfaces of the valve, by referring to FIG. 4.

The valve according to the present embodiment has a curved surface formed on the surface thereof, within a range so that it is able to contact the valve on all around the periphery surface thereof, even if it is eccentric from. Namely, on the valve 17, as shown in the FIG. 4, a section "a-b" of curved surface is provided within a range of $\epsilon$ ($\geqq\delta 1+\delta 2+\delta 3$) at a center of the seal portion 17 when the valve 17 is in no eccentric (i.e., concentric) condition, to be contact with the valve seat 18, so that the valve 17 can contact the valve seat 18 on all around the periphery surfaces thereof, even in the condition where it is inclined, i.e., if the valve 17 comes in eccentric from the valve seat 18 due to mounting (or assembling) clearances, for example, clearance $\delta 1$ defined between the insertion portion 6*a* of the sub-bearing 6 and the retainer 20 in the direction of diameter, clearance $\delta 2$ between the retainer 20 and the coiled spring 19, and clearance $\delta 3$ between the coiled spring 19 and the valve 17.

Next, explanation will be given on the configuration of the valve 17, in more details thereof. In the FIG. 4, a side surface of the valve 17 has a spherical portion (the section "a-b") and a conical portion (a section "b-c"). The valve 17 is provided as was mentioned in the above, for reducing the clearance volume within the discharge port 14 through an entire body thereof, and in particular, the spherical portion (the section "a-b") mentioned above is a portion that is provided for sealing between the cylinder 4 side and the discharge chamber 16 side of the compressor mechanism portion within the discharge port 14, by contacting with the surface of the valve seat 18, while the conical shaped portion (the section "b-c") is a portion provided for reducing the clearance volume by fitting to the shape of the valve seat 18 within the discharge port 14. Length in the horizontal direction of the spherical portion (the section "a-b") can be expressed by the following equation:

$$\epsilon=SR(\sin\alpha-\sin\beta 1)=SR(\sin\beta 1-\sin\beta 2)$$

where, "$\alpha$" is an angle defined by a central axis of the valve 17 being almost axial-symmetric in the shape and a straight line connecting between a center "O" of the spherical portion and a point "a", "$\beta 1$" an angle defined by the central axis of the valve 17 and a straight line connecting between the center "O" of the spherical portion and a contact point of the valve 17 when it is seated on the valve seat 18 in concentric therewith, "$\beta 2$" an angle defined by the central axis of the valve 17 and a straight line connecting between the center "O" of the spherical portion and a point "b", and "SR" a radius of the spherical portion.

Further, among arc angles ($\alpha-\beta 1$) and ($\beta 1-\beta 2$) of the spherical portion, an angle 01 of the conical portion and an angle $\theta 2$ of the valve seat 18, the following relationships can be founded:

$$(\alpha-\beta 2)\geqq(\beta 1-\beta 2)$$

$$(\beta 1-\beta 2)\geqq(\theta 1-\theta 2)/2$$

With such the construction as mentioned in the above, the valve can contact the valve seat 18 at the spherical portion (the section a-b) on a line all around thereof even when the valve 17 is inclined with respect to the valve seat 18 due to the clearances $\delta 1$ through $\delta 3$, therefore it is possible to obtain sealing by means of the valve 17, as well as reduction in the clearance volume.

Next, explanation will be given on assembling of the discharge valve 13 according to the present invention, by ref erring to FIGS. 5 to 7. The FIG. 5 is an exploded perspective view of parts constructing the discharge valve of the present embodiment. A sequence for assembling each of the parts, which are shown in the FIG. 5, is shown in the FIGS. 6(*a*) through 6(*c*). As shown in the FIG. 6(*a*), the retainer 20 and the coiled spring 19 and the valve 17 are fixed to one another, in such the condition that an end turn portion 19*c* on one end of the coiled spring 19 is tightly fitted into a bottom surface 20*a* of the retainer 20 where the wire material thereof is wound around on the maximum radius, while an end turn portion 19*b* on the other end thereof onto the valve 17 where the wire material is wound on the minimum one, by tying them with remaining to be tighten. In the present embodiment, as is shown in this figure, the retainer 20 and the valve 17 are fitted to or engaged with the coiled spring 19 each other, respectively, and then they are treated with as if being a one part, to be assembled into the discharge port 14.

Figure 7:
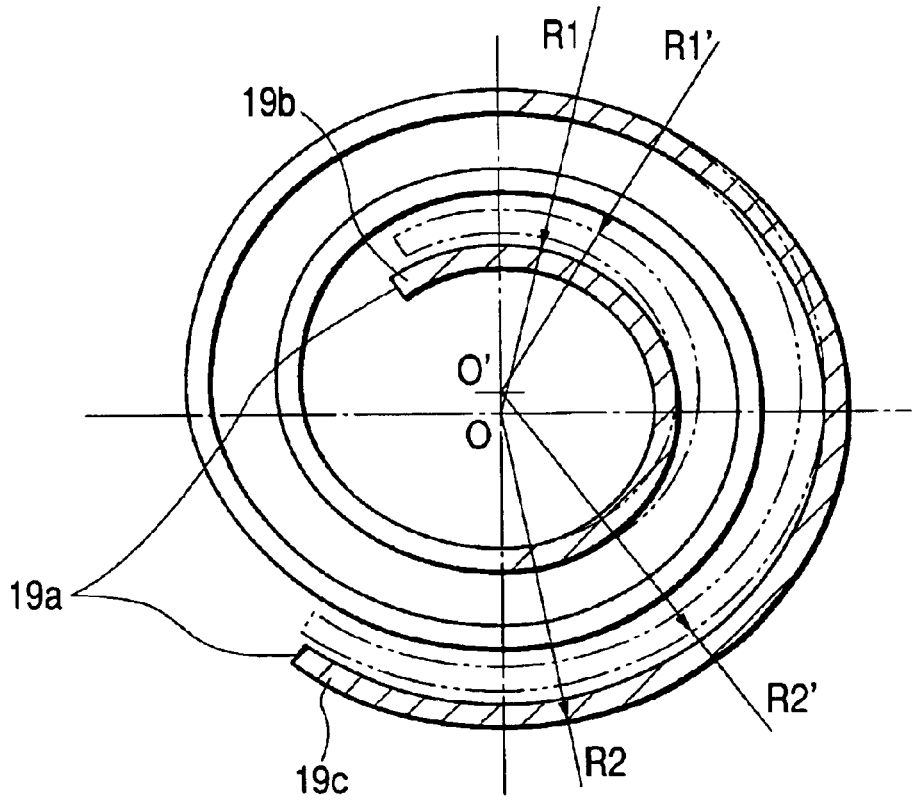
FIG. 7 is a plan view for showing a condition where a coiled spring is engaged within the discharge valve of the compressor shown in the FIGS. 1(*a*) and 1(*b*)

This coiled spring 19 mentioned above is in one body, together with the retainer 20 and the valve 17, under the condition as shown by two-dotted chain lines in FIG. 7. The portions treated with hatching lines indicate the end turn portions 19*a*, wherein they are wound about by 0.6 turn at the minimum and the maximum radius, respectively, and further, each one of the end turn portion 19*b* of the minimum radius and the end turn portion 19*c* of the maximum radius is axial-symmetric in the region thereof. Fitting the end turn portion 19*b* of the minimum radius onto the valve 17 by tying up changes the radius from "R1" to "R1'", and the center thereof from "O" to "O'".

Next, fitting the end turn portion 19*c* of the maximum diameter onto the retainer 20 by tying up also changes the radius thereof from "R2" to "R2'", however since both the end turn portions of the maximum radius and the minimum radius are tied up with the same remaining, the center of that radius "R2" comes to "O'", and then it comes to be coincident with the center of the above-mentioned "R1'". As a result of this, the retainer 20 and the valve 17 can be formed in one body with the coiled spring, concentrically. Also, due to the change in shape into a conical one by making the effective turn number thereof small (for example, 1.5 turn in the present embodiment), rigidity of the coiled spring 19 can be strengthen, thereby enabling to suppress the decentering of the valve when moving.

Figure 6A:
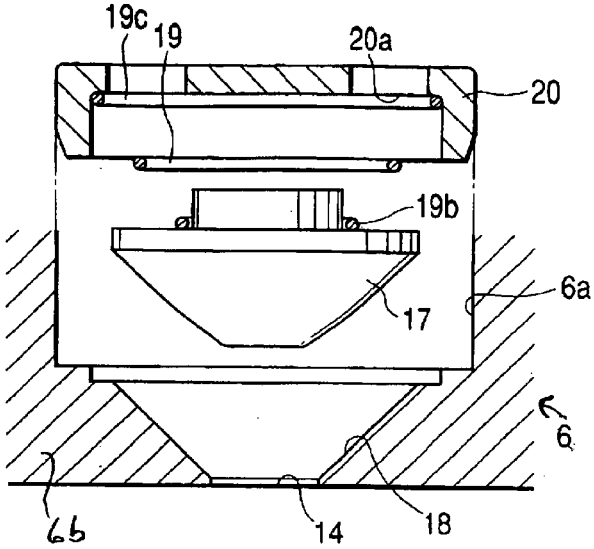
FIGS. 6(*a*) through 6(*c*) are views for explaining an assembling method of the discharge valve of the compressor shown in the FIGS. 1(*a*) and 1(*b*)
Figure 6B:
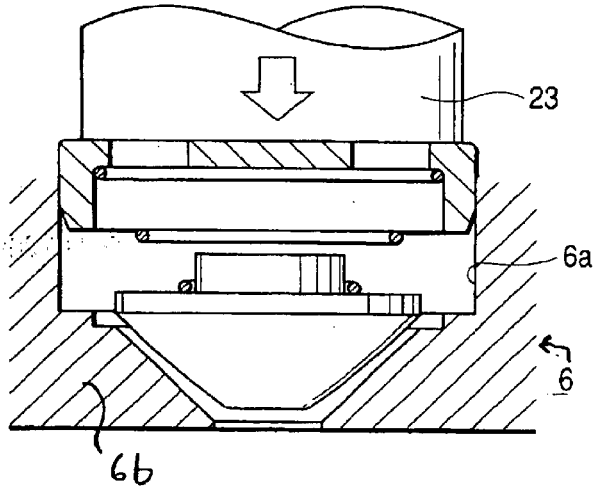
Figure 6C:
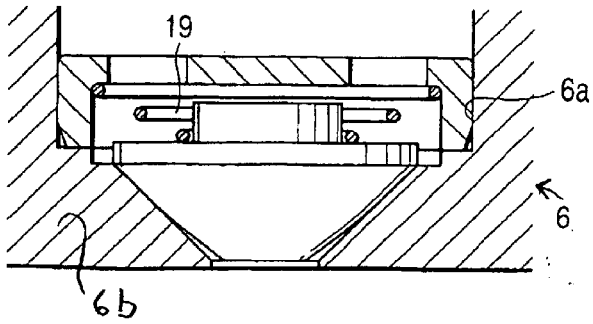

And, this part assembled in one body, as shown in FIG. 6(*b*), is inserted into an insertion portion 6*a* of the sub-bearing 6 by means of a press-fitting jig 23, in concentric with the valve seat 18, thereby to be fixed thereto. Also, as shown in FIG. 6(*c*), the coiled spring 19 is attached under the condition of being suppressed to be shorter than the free length thereof, therefore it applies spring force upon the valve 17 to be biased even under the condition that the valve is closed. Application of the spring force upon the valve 17 even under the closing condition of the valve, in this manner, suppresses rebounding of the valve 17 due to collision when the valve 17 is seated on the valve seat 18, thereby effecting to prevent the valve from being delayed when it is closed.

Figure 8A:
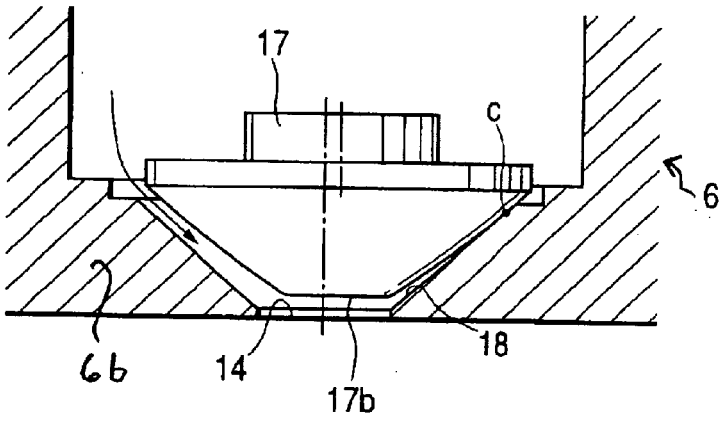
FIGS. 8(*a*) and 8(*b*) are views for explaining inclination of the valve of the discharge valve shown in the FIGS. 1(*a*) and 1(*b*), in particular when it is seated.
Figure 8B:
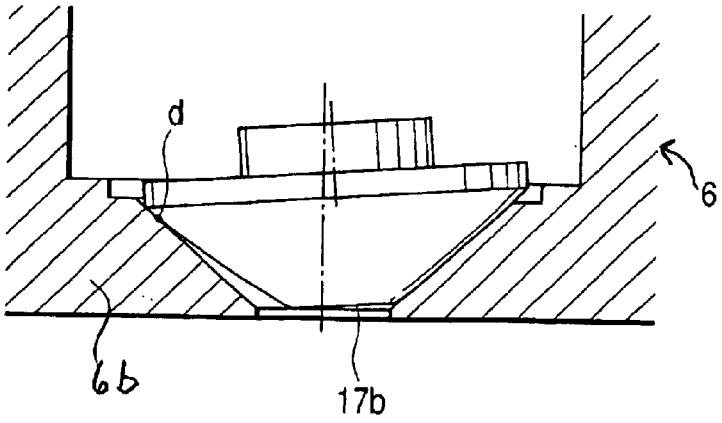

Next, explanation will be given on movement of the valve, by referring to FIGS. 8(*a*) and 8(*b*). As be shown in those figures, in a case where the valve 17 is seated on the valve seat 18 in an eccentric condition, first the valve 17 contacts the valve seat 18 at a point "c" thereof, and thereafter at a point "d" on the opposing side with time-delay. This time difference comes to be a cause to delay inclosing of the valve, however such the application of the spring force under the condition where the valve is closed enables quick seating of the valve from the point "c" to the point "d", thereby preventing the valve from delay in closing.

Further, since the bottom surface 17*b* of the valve 17 is formed, so that the valve 17 does not protrude or project into the compression chamber even when it is seated with inclination, it also can be applied into a compressor, such as an oscillating piston compressor shown in the present embodiment, in which the valve and the piston move in the directions being orthogonal to each other.

Next, explanation will be given on a machining method of the valve seat 18, by referring to FIGS. 9(*a*) through 10(*b*). Those FIGS. 9(*a*) through 10(*b*) are vertical cross-section views of showing steps for machining the valve seat portion, on which is seated the discharge valve of the compressor according to the present invention.

Figure 23:
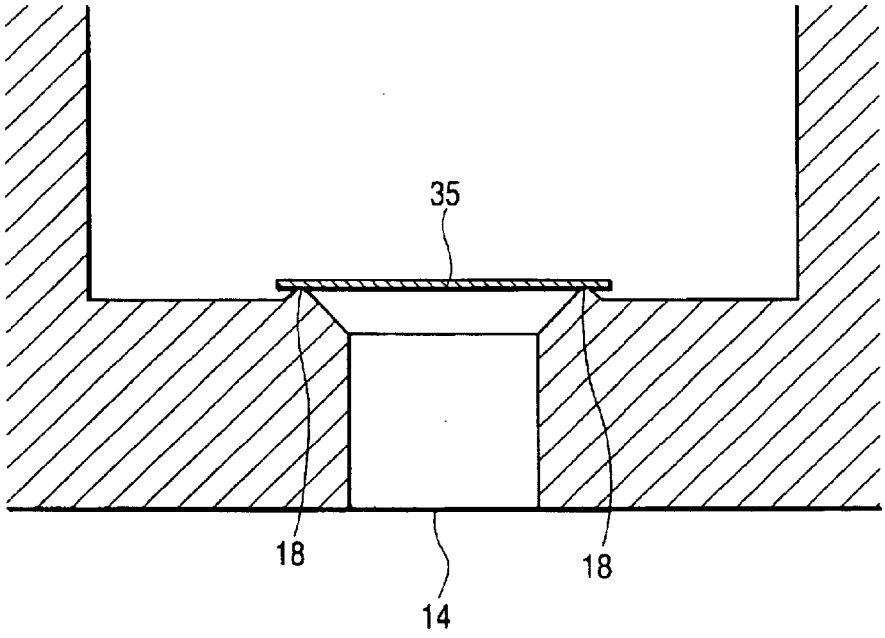
FIG. 23 PRIOR ART
FIG. 23 is an enlarged cross-section view of a reed valve, which is widely applied as the discharge valve in the conventional art.

As was mentioned in the above, the reed valve which was used as the discharge valve widely in the conventional art, has the structure that, as shown in the FIG. 23, the discharge port is covered by a thin plate-like valve seat 35. With this reed valve, since the plate-like valve seat 35 is able to cover the port outlet as a whole even if it is shifted a little bit to the valve seat 18 in position, the valve 35 can seal the port 14, therefore chance is small for it to have an important influence upon the performance of compression in the compressor. On the contrary to this, with the compressor having such the structure, in which the valve of the discharge valve has such the configuration that it fills up the inside of the discharge port, as in the present embodiment, the valve deteriorates the sealing capacity and/or causes delay in closing, thereby lowering the performances of the compressor, in particular when the valve 17 is seated on the valve seat 18 in such the eccentric or decentering manner therewith.

Then, it is preferable that the valve 17 and the valve seat 18 are disposed as in concentric with as possible.

According to the present embodiment, the valve 17 and the coiled spring 19 and the retainer 20 are assembled in one body, and are inserted into the insertion portion 6*a*. Namely, the discharge valve 13 in the present embodiment has such the structure that the positional relationship between the insertion portion 6*a* and the retainer 20 is restricted by the positional relationship of the valve 17 to the valve seat 18. Then, as was mentioned in the above, it is very important to dispose the insertion portion 6*a* and the valve seat 18, concentrically, for the purpose of disposing the valve 17 and the valve seat 18, concentrically.

Figure 9A:
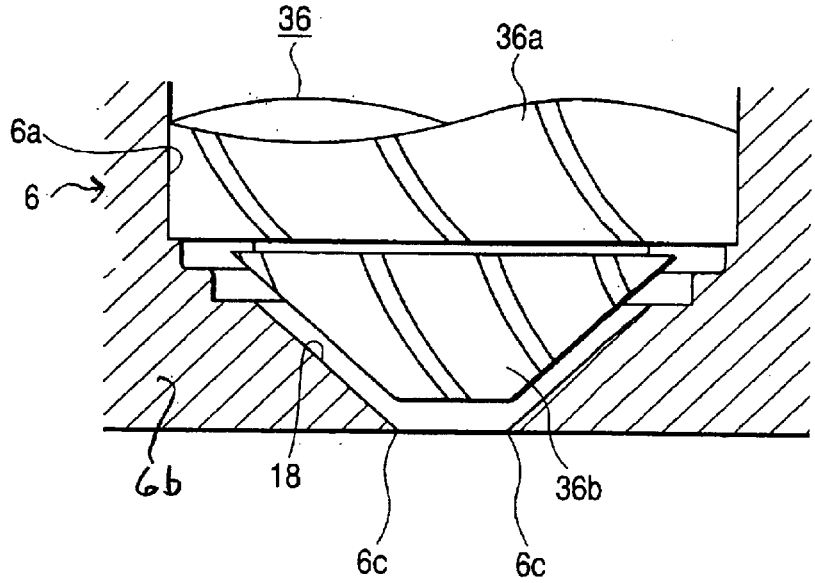
FIGS. 9(*a*) and 9(*b*) are the vertical cross-section views for showing machining processes of a valve seat, on which the discharge valve is seated, in the compressor shown in the FIGS. 1(*a*) and 1(*b*)
Figure 9B:
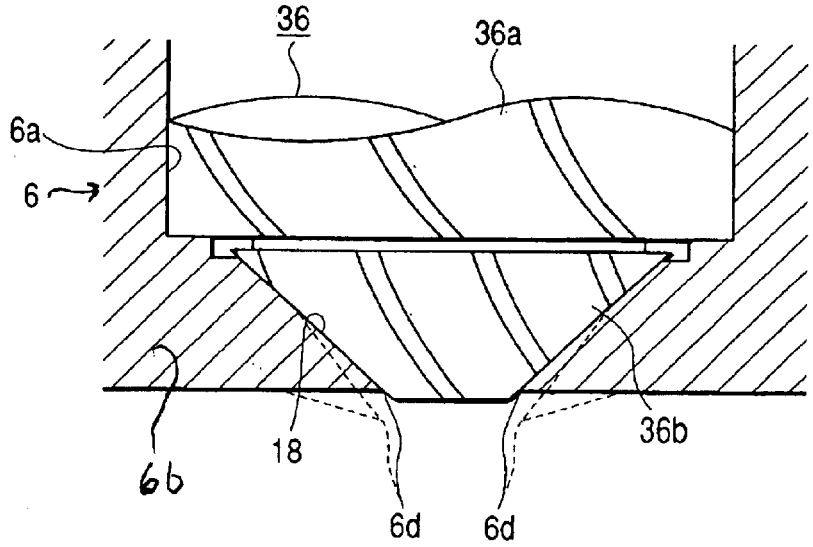

In the present embodiment, as shown in FIGS. 9(*a*) and 9(*b*), the valve seat 18 and the retainer insertion portion 6*a* are machined by means of a cutting tool 36. In those FIGS. 9(*a*) and 9(*b*), the cutting tool 36 has a first portion 36*a* for cutting the sub-bearing 6, so as to form the insertion portion 6*a* and an inner side surface thereof, and a second portion 36*b*, provided on tip side of the first portion 36*a*, for cutting the sub-bearing 6, so as to form an inclined surface on the valve seat 18. In this cutting tool 36 according to the present embodiment, the first and the second portions are formed in concentric with the axial center thereof, therefore cutting-through of the cutting tool 36 to the sub-bearing 6 forms the insertion portion 6*a* and the valve seat 18, concentrically.

With the cutting tool 36 of such the structure, it is possible to achieve work of forming, not only the insertion portion 6*a*, but also the valve seat 18, at the same time. With this, the work can be lessened in steps thereof, comparing to the case of performing it by steps separately, thereby reducing production cost thereof. Further, since there is no necessity of steps for positioning to fit with the configure, which was made up in a previous step, in a step following thereafter, an accuracy in the work step depends upon that of the configure obtained by the cutting tool 36, therefore it is possible to form the configure with high accuracy, comparing to the case where the steps are performed separately, as was mentioned above.

Also, with the configure of the valve seat 18 shown in those FIGS. 9(*a*) and 9(*b*), since a member of the sub-bearing in the vicinity of the edge portion 6*c* is thin in the thickness, there is a possibility that the thin portion is deformed, like in a shape of an edge portion 6*d* shown by broken lines, when being machined. If such the edge portion 6*c* projects into the inside of the cylinder, it comes contact with the piston, the rotor and the scroll, thereby injuring or damaging them. While, if trying to make the piston to escape from the projecting portion of the edge portion 6*c*, the volume efficiency of the compressor is reduced.

Also, if such the deformation occurs, the inclination is changed on the surface of the valve seat 18, being made up by cutting until then. If the surface of the valve seat 18 is cut out by means of the cutting tool 36 in this condition, it is impossible to form the valve seat 18 with an appropriate angle of the inclination.

Figure 10A:
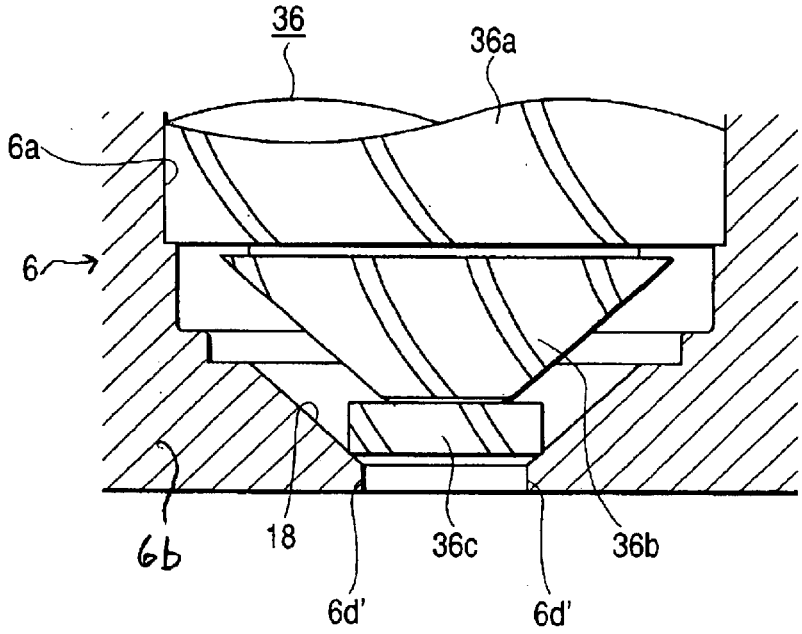
FIGS. 10(*a*) and 10(*b*) are also the vertical cross-section views for showing machining processes of a valve seat, on which the discharge valve is seated, in the compressor shown in the FIGS. 1(*a*) and 1(*b*)
Figure 10B:
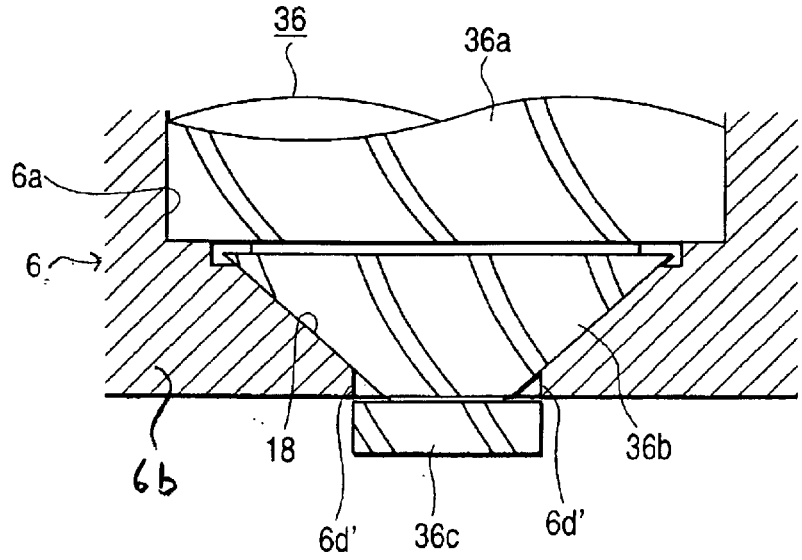

Then, it is necessary to make the deformation in the edge portion 6*c* of the valve seat 18 as small as possible. According to the present embodiment, as shown in FIGS. 10(*a*) and 10(*b*), a cylindrical portion 6*d*' is provided on the valve seat 18 provided within the sub-bearing 6 at the cylinder 4 side. In this instance, on the cutting tool 36 is further provided a third portion 36*c* for cutting out the above-mentioned cylindrical portion 6*d*, at a tip of the second portion 36*b*. With such the cutting tool 36, the cylindrical portion 6*d*' can be formed on the valve seat 18 at the cylinder 4 side, at the same time when the insertion portion 6*a* or the valve seat 18 is formed with.

With such the structure, it is possible to ensure the thickness of the member corresponding to the edge portion 6*c* of the sheet member, by height of the cylindrical surface of the cylindrical portion 6*d*', when forming the valve seat 18, and due to this, it is possible to reduce the deformation of the sheet member, thereby lowering the protrusion of the edge portion 6*c* into the inside of the cylinder. Furthermore, it is also possible to form the valve seat 18 with an appropriate inclination, therefore it is possible to improve the sealing characteristic between the valve seat 18 and the valve 17.

As was mentioned in the above, the discharge valve 13, according to the present embodiment, is formed, so that it can be fit into the discharge port formed by the valve seat 18, while forming the surface configuration of the valve 17, which comes contact with the valve seat 18, in a curved surface, therefore it is possible to reduce the clearance volume in the discharge port portion. Further, by making the valve 17 and the valve seat 18 have curved surfaces being different each other in the shapes thereof, the contact region between them comes to be in a circle, and further be nearly in such the condition that they contact each other on a line between them. With this, it is possible to reduce the clearance volume greatly, at the discharge port portion while maintaining the sealing between the valve 17 and the valve seat 18, as well as to reduce the loss due to re-expansion.

Also, since the section, on which sealing is obtained through contacting between the valve 17 and the valve seat 18, is defined on a region, so that the sealing can be obtained all around thereof even if the valve 17 is eccentrically seated on the valve seat 18 with inclining thereto, there is no need of fine adjustment for assembling the valve 17 and the valve seat 18 concentrically, thereby achieving easiness in assembling. Further, the valve 17 is biased so that the spring force is applied on it under the condition where the valve is closed, it is possible to suppress the rebounding of the valve 17, which is caused due to the collision when it is seated on the valve seat 18, as well as the delay in closing, which is caused due to the inclination of the valve 17 when it is seated on the on the valve seat 18 eccentrically therefrom.

Also, since the retainer 20 and the coiled spring 19 and the valve 17 are unified in one body, and since the retainer 20 mentioned above is fixed into the insertion portion 6*a* of the sub-bearing 6, which is formed in concentric with the valve seat 18, through press-fitting, it is possible to make the assembling further easy, as well as to suppress the delay in closing due to the inclination of the valve when it is seated, since the valve 17 and the valve seat 18 can be assembled to be in almost concentric with each other.

Next, the performances of the compressor according to the embodiments shown in the FIGS. 1 to 7 are compared with those of the example of applying the reed valve as the discharge valve according to the conventional art. The compressor of this example is same to the oscillating piston compressor shown in the FIGS. 1(*a*) and 1(*b*), except for that the reed valve of the conventional art is applied as the discharge valve.

Figure 11:
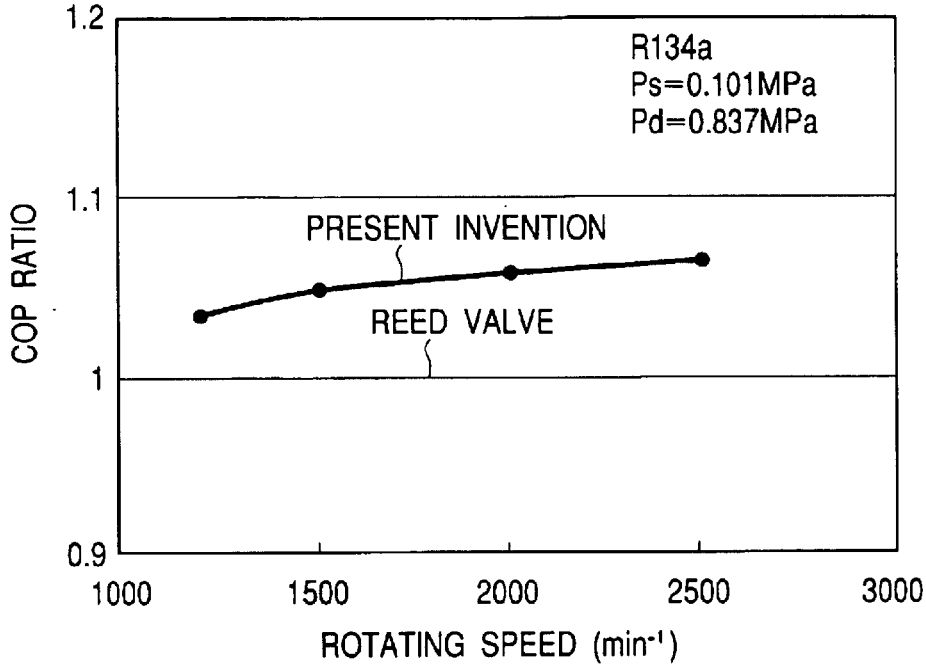
FIG. 11 is a graph of showing performances of the compressor according to the present invention and that to the prior art, in comparison therebetween.

An example of experimental results is shown in FIG. 11. This figure is a graph of showing a relationship between rotating speed and coefficient of performance "COP" (=refrigeration capacity/electric power consumption) for comparing the performances between the discharge valve according to the present embodiment and that of the conventional art. Herein, refrigerant is R134a, and the condition of experiments is that, suction pressure is Ps=0.101 MPa and discharge pressure Pd=0.837 MPa, corresponding to actual operating condition of refrigerators. The coefficient of performance "COP" is indicated by ratio, being set to 1.0 for the COP of the reed valve. Form the figure, with the discharge valve according to the present invention, it is apparent that the COP ration increases up by about 3% to 6%, and that the performance is improved by making the clearance volume almost to zero (0), so as to reduce the loss due to the re-expansion, comparing to that of the reed valve.

Figure 12:
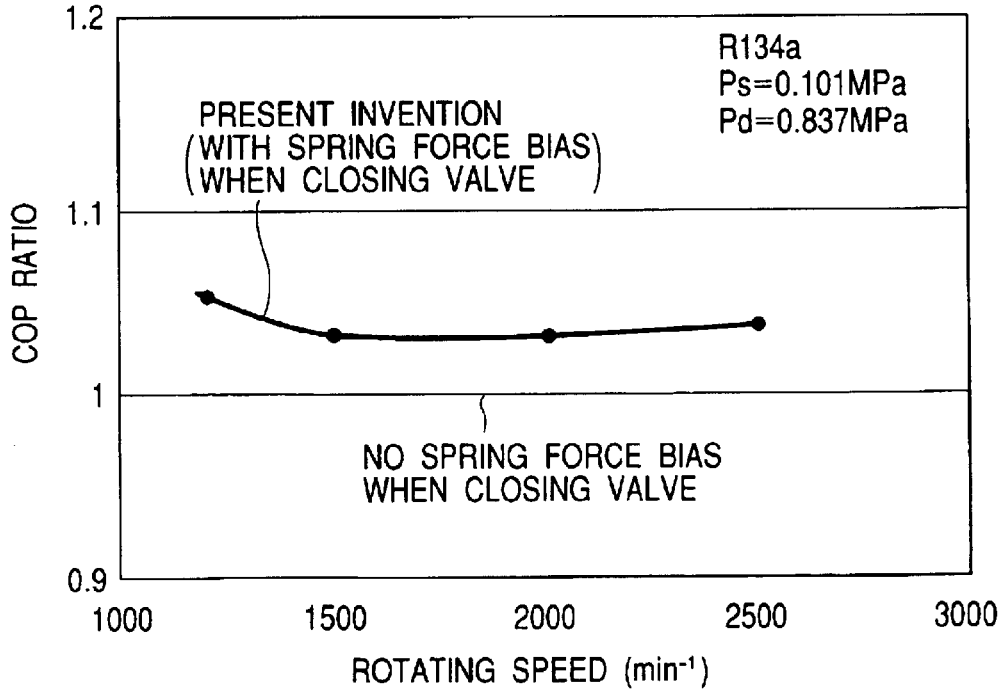
FIG. 12 is a graph of showing performances of the compressor according to the present, in comparison between cases where the discharge valve is biased by spring and where it is not.

Next, a result of comparison is shown in FIG. 12, which is made on the performances of the compressors, in particular, between a case of applying the spring force on the valve when it is closed and a case of applying no such the force thereon, under the experimental condition that is shown in the FIG. 11. The COP of the compressor is indicated by ratio, being set to 1.0 when no spring force is applied onto the valve when it is closed. From the figure, it is apparent that the COP ratio is improved by about 3% to 5%, comparing the case of biasing the valve with the spring force when it is closed to the case of biasing with no such the spring force. Biasing the valve with the spring force may be considered to be a cause of increasing the excessive compression loss, thereby lowering the performances of the compressor. However, from this experimental result, in case of applying a poppet type discharge valve, which is likely to be thick in the thickness of the valve and therefore heavy in the weight, it becomes clear that suppression of the delay inclosing of the valve due to the rebounding and/or the inclination of the valve when it is seated is more important than reduction of such the excessive compression loss.

From the above, according to the present embodiment, the loss can be reduced, which is caused from the clearance volume at the discharge port portion, thereby improving the efficiency of the compressor. Also, the compressor can be improved in assembling workability and productively. According to the present embodiment, the valve is formed in the spherical shape while the valve seat in the conical one, however those should not be restricted only thereto, and the same effect may be obtained if they are formed in such the shapes that the sealing can be obtained all around the periphery surfaces thereof even if the valve is inclined, such as, in the spherical shapes both. Also, though the discharge valve 13 is disposed on an end plate of the sub-bearing 6, in the present embodiment, it is also possible to obtain the same effect to the present embodiment, if it is disposed on the end plate of the main bearing 5 or a side wall of the cylinder 4.

Also, the explanation was given on the example of the compressor having only one cylinder, for example, listing up such as the oscillating piston compressor, however it is also possible to apply the present embodiment to an oscillating piston compressor having two (2) or more cylinders or to a rotary compressor having two (2) or more cylinders other than that mentioned above.

Figure 13:
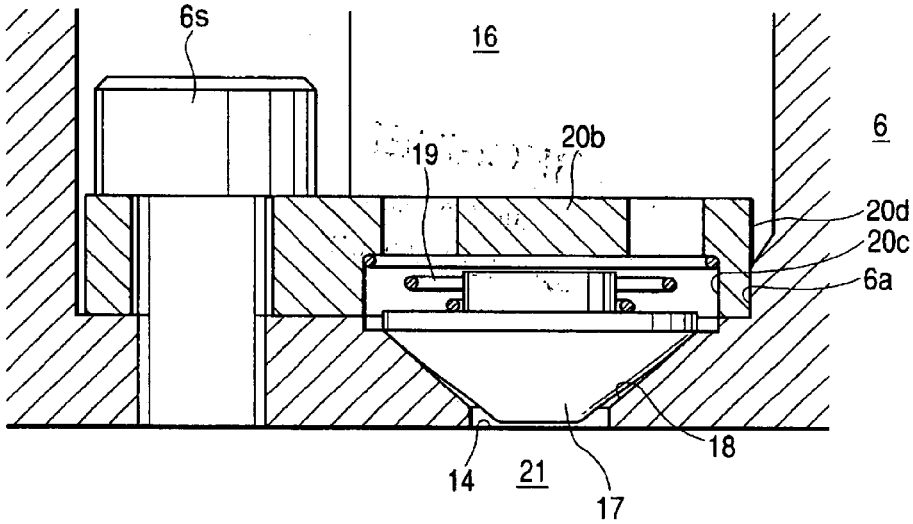
FIG. 13 is an enlarged cross-section view for showing another embodiment of the compressor, according to the present invention.
Figure 14:
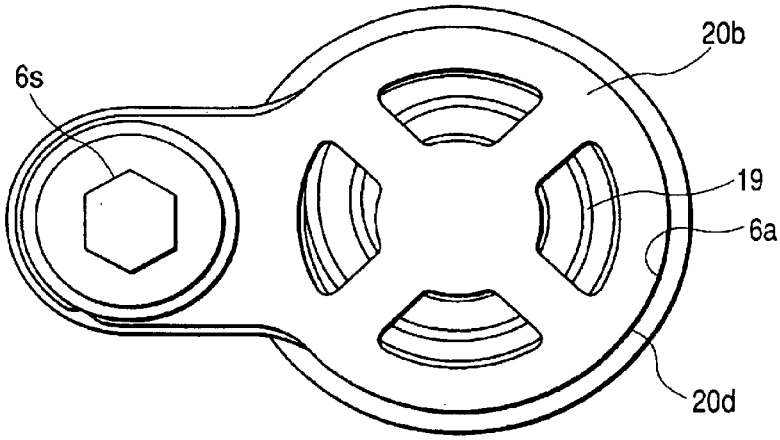
FIG. 14 is a top plane view of the compressor shown in the FIG. 13.

Explanation will be given on other embodiment according to the present invention, by referring to FIGS. 13 and 14. The FIG. 13 is the enlarged vertical cross-section view for showing, in particular in the vicinity of the discharge valve of the other embodiment of the compressor having the discharge valve according to the present invention. The FIG. 14 is a top plane view of the compressor shown in the FIG. 11. The valve according to this embodiment is same to that of the discharge valve shown in those FIGS. 2 and 3, in the operation thereof, however it differs from that in the manner of fixing the retainer thereof.

In those FIGS. 13 and 14, the retainer 20*b* is inserted, so that an outer periphery portion 20*d* of a receiving portion 20*c* for receiving the coiled spring 19 therein keeps a fine clearance of about 50 $\mu$m from an inner side surface of an insertion portion 6*a*, which is defined by a bore of the sub-bearing for insertion of the retainer, and is fixed onto the sub-bearing 6 through a screw 6*s*. With this, the valve 17 and the valve seat 18 can be assembled almost in concentric with each other, but without rotating the retainer 20*b* accompanying with squeezing-up of the screw 6*s* when being screwed.

According to this, since the valve 17 can be prevented from the inclination when it is seated onto the valve seat 18, it is possible to suppress the delay in closing of the valve. Further, the discharge port 14 and the valve seat 18 are free from the deformations due to the press-fitting of the retainer 20*b* and the sub-bearing 6, therefore it is possible to provide the discharge valve for the compressor, being high in the assembling workability as well as the productivity thereof, and furthermore being superior in sealing property thereof.

Next, explanation will be given on further other embodiment according to the present invention, by referring to FIGS. 15 and 16.

Figure 15:
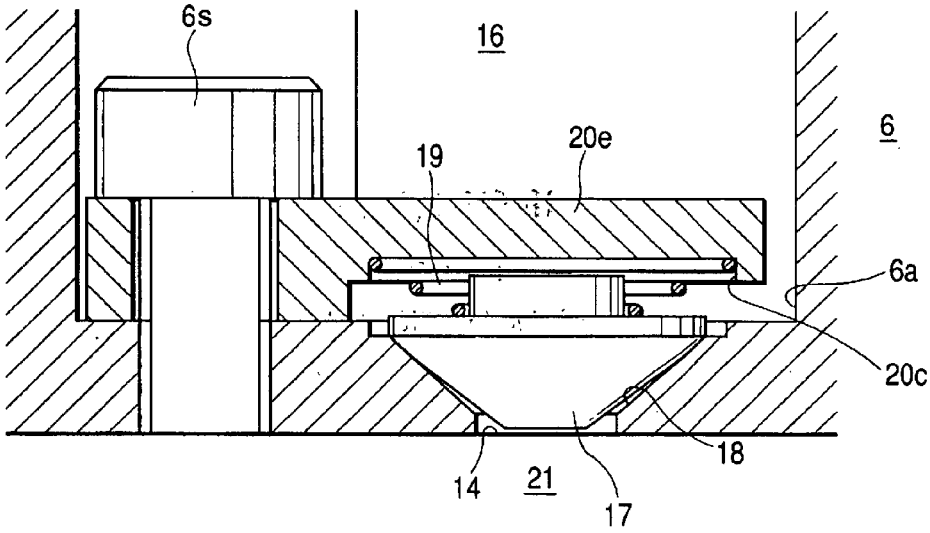
FIG. 15 is an enlarged cross-section view for showing other embodiment of the compressor, according to the present invention.

The FIG. 15 is the enlarged vertical cross-section view for showing, in the vicinity of the discharge valve of the further other embodiment of the compressor having the discharge valve according to the present invention. The FIG. 16 is a top plane view of the compressor shown in the FIG. 15. The discharge valve according to this embodiment differs from that shown in those FIGS. 13 and 14, in particular in the configuration of the discharge passage defined between the discharge valve and the retainer.

Figure 16:
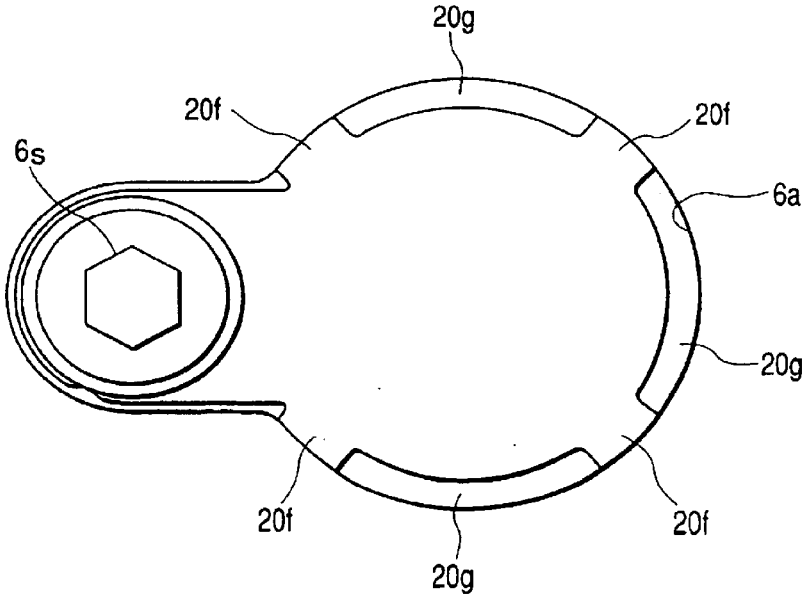
FIG. 16 is a top plane view of the compressor shown in the FIG. 15.

In those FIGS. 15 and 16, on the retainer 20*e* are formed plural numbers of guide portions 20*f*, which are radially projecting from the spring receiving portion 20*c*. A tip (outer peripheral) portion of this guide portion 20*f* is inserted, while keeping a fine clearance of about 50 $\mu$m from the side-wall surface of the insertion portion 6, which is defined by the insertion bore of the sub-bearing 6, being formed in concentric with the valve seat 18 to be inserted with the retainer therein. Herein, the working fluid (the refrigerant) passing by the valve 17 is discharged through a cutting portion 20*g* formed in an outside of the spring receiving portion 20*c*.

With this, since it is possible to enlarge the area of the discharge passage for the working fluid after passing by the valve 17, and further it is possible to discharge the working fluid, being discharged toward an outer direction from the valve 17, smoothly from the cutting portion 20*g* formed on an outside of the spring receiving portion 20*c*, then the pressure loss can be reduced, thereby providing the discharge valve being suitable for the compressor having a large flow-rate, too.

Figure 17:
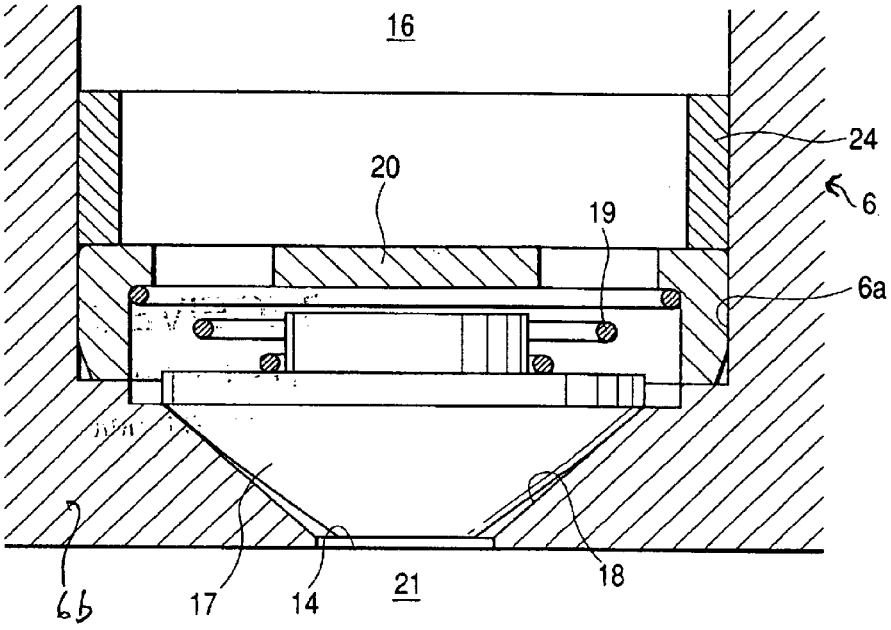
FIG. 17 is an enlarged cross-section view for showing further other embodiment of the compressor, according to the present invention.

Explanation will be given on further other embodiment according to the present invention, by referring to FIG. 17. The FIG. 17 is the enlarged vertical cross-section view for showing, in particular in the vicinity of the discharge valve of the further other embodiment of the compressor, which has the discharge valve according to the present invention.

The valve according to this embodiment is same to that of the discharge valve shown in those FIGS. 2 and 3 mentioned above, in the operation thereof, however it differs from in the manner of fixing the retainer thereof. In the FIG. 17, the retainer 20 is inserted while keeping the fine clearance of about 50 $\mu$m from the inner wall surface of the insertion portion 6*a*, which is formed in concentric with the valve seat 18 and is defined by the bore on the sub-bearing to be inserted with the retainer therein, and then a collar 24 is pressed from above into the insertion portion 6*a* thereof, thereby press-fitting the retainer 20 into the insertion portion of the sub-bearing 6 through the collar 24 mentioned above.

According to this, since the valve 17 and the valve seat 18 are assembled in almost concentric with each other, so that the delay in closing of the valve due to the inclination of the valve can be suppressed when it is seated, and since the retainer 20 is not press-fitted by itself, it is possible to prevent the retainer 20 or the discharge port 14 and the valve seat 18 from the deformation thereon. With such the construction, good assembling workability and productivity can be obtained, and also the property of sealing between the valve and the valve seat can be improved, therefore it is possible to provide the compressor being superior in efficiency thereof.

Figure 18A:
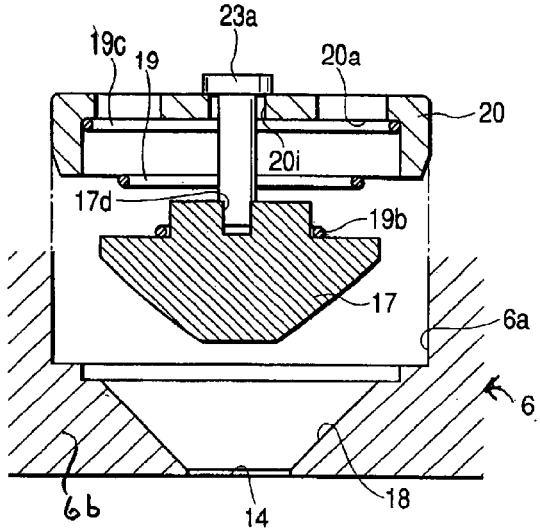
FIGS. 18(*a*) through 18(*c*) are view for explaining the assembling method of the compressor according to the present invention.
Figure 18B:
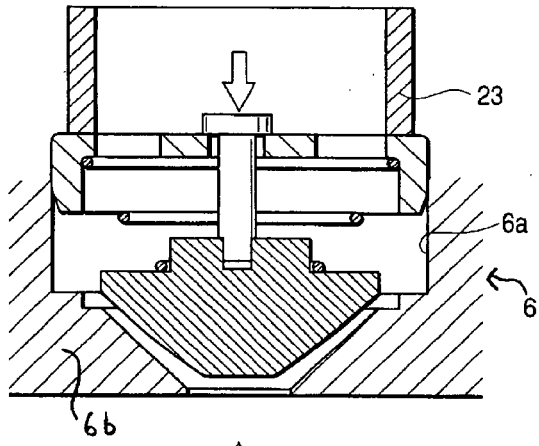
Figure 18C:
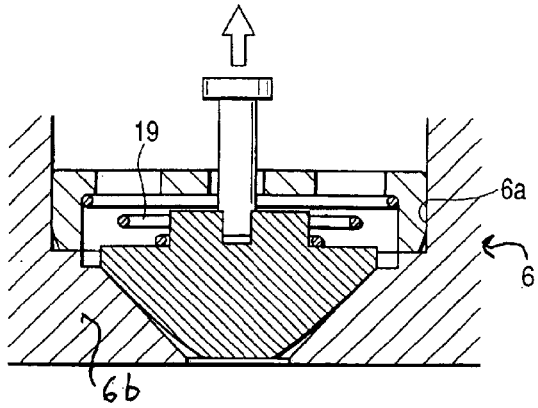

Next, another method for assembling the retainer 20, the coiled spring 19 and the valve 17 is shown in FIGS. 18(*a*) through 18(*c*), with the structures of those which are shown in the FIGS. 6(*a*) through 6(*c*).

With the structure of the discharge valve according to the present embodiment, as shown in FIG. 18(*a*), a penetrating bore 20*i* is formed at a central portion of the retainer 20 while a recessed portion 17*d* at a central portion of the valve 17. Insertion of an assembling assist member 23*a* of elasticity, such as robber, resin material, etc., into those penetrating bore 20*i* and recessed portion 17*d* mentioned above brings them to be in a form of one body. Those parts assembled in one body, as shown in FIG. 18(*b*), are fixed through press-fitting of the retainer 20 into the insertion portion 6*a* of the sub-bearing 6, which is formed in concentric with the valve seat 18, by means of a press-fitting tool 23. After the press-fitting, as shown in FIG. 18(*c*), the assembling assist member 23*a* is removed out, and the discharge valve is provided or positioned.

With doing so, the retainer 20 and the coiled spring 19 and the valve 17 can be formed in one body with the force due to elastic deformation of the assembling assist member 23*a*, thereby enabling easy assembling thereof.

Figure 19:
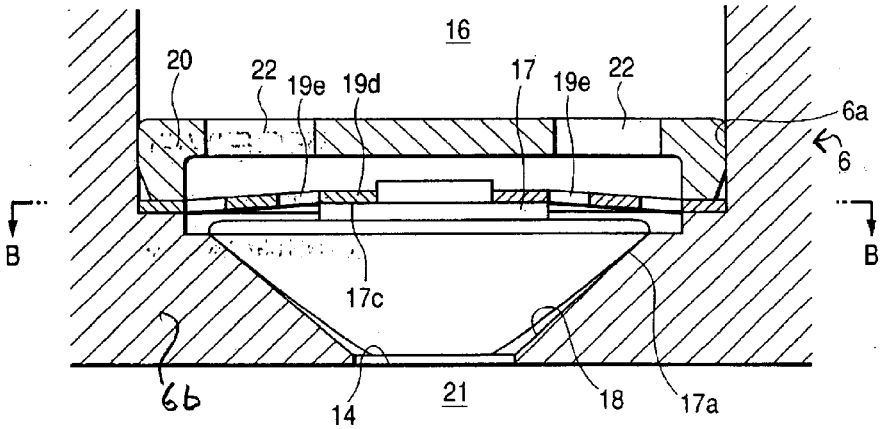
FIG. 19 is an enlarged cross-section view for showing further other embodiment of the compressor, according to the present invention.
Figure 20:
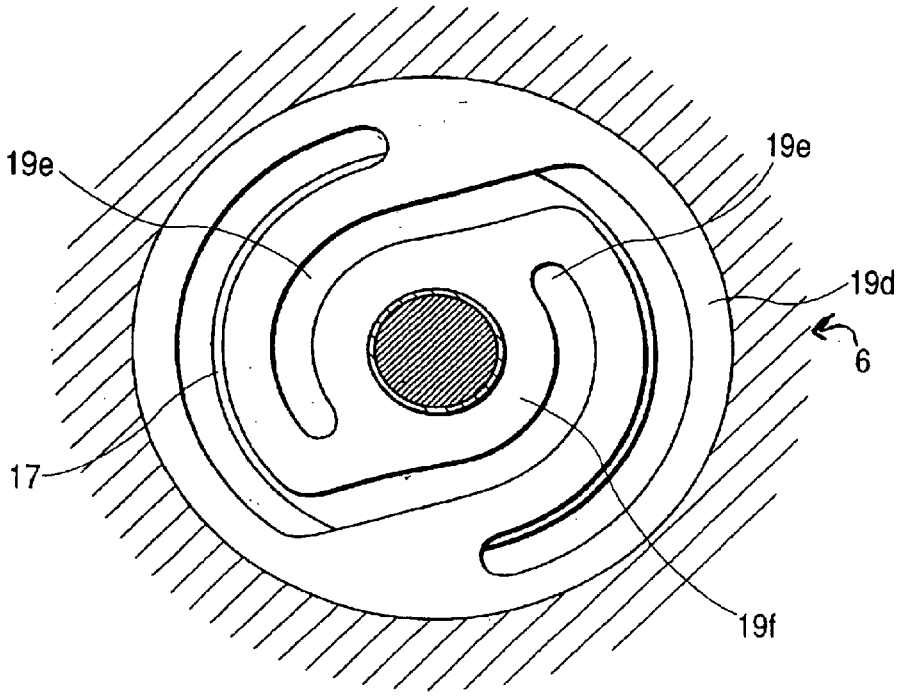
FIG. 20 is a B—B cross-section view of the compressor shown in the FIG. 19.

Next, explanation will be given on further other embodiment according to the present invention, by referring to FIGS. 19 and 20. The FIG. 19 is the enlarged vertical cross-section view for showing, in the vicinity of the discharge valve of the further other embodiment of the compressor, which has the discharge valve according to the present invention. The FIG. 20 is a B—B cross-section view of the compressor shown in the FIG. 19, in the vicinity of the discharge valve thereof. The operation of the discharge valve according to this embodiment is similar to that in the case of the discharge valve shown in those FIGS. 2 and 3 mentioned above, however the spring for giving the bias onto the valve 17 is in a form of a plate-like spring.

According to the present embodiment, as shown in the FIGS. 19 and 20, the valve 17 is biased toward the valve seat by means of the leaf spring 19*d*. This leaf spring 19*d*, being provided with slits on a flat plate-like sheet member thereof in symmetry with respect to the central portion where the valve 17 is held thereon, as shown in the FIG. 18, is movable in parallel to an upper surface 17*c* of the valve 17, at a central portion 19*f* thereof. Also, this leaf spring 19*d* is fixed with an outer peripheral portion thereof, within the insertion portion, by means of the retainer, which is press-fitted into the insertion bore, i.e., the insertion portion 6*a*.

With this, the space volume can be reduced, in which the spring is disposed, thereby enabling small-sizing of the discharge valve as a whole.

Also, since it is possible to make the rigidity in the horizontal direction stronger than the coiled spring, as well as light-weighting of the valve 17, it is possible to make the decentration of the valve 17 to the valve seat 18 much smaller, thereby suppressing the delay in closing of the valve 17 due to the inclination much shorter.

Next, explanation will be given on a reciprocating type compressor installing the discharge valve therein, which is explained in the embodiment mentioned above, by referring to FIGS. 21 and 22.

Figure 21:
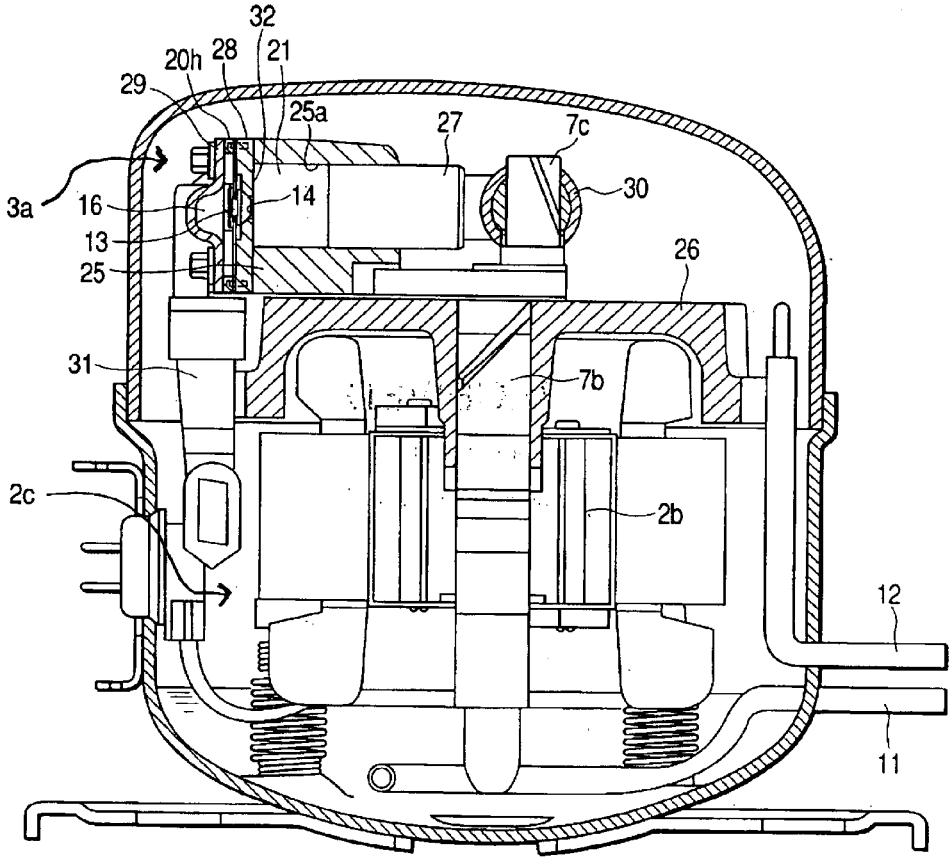
FIG. 21 is a vertical cross-section view of further other compressor, according to the present invention.
Figure 22:
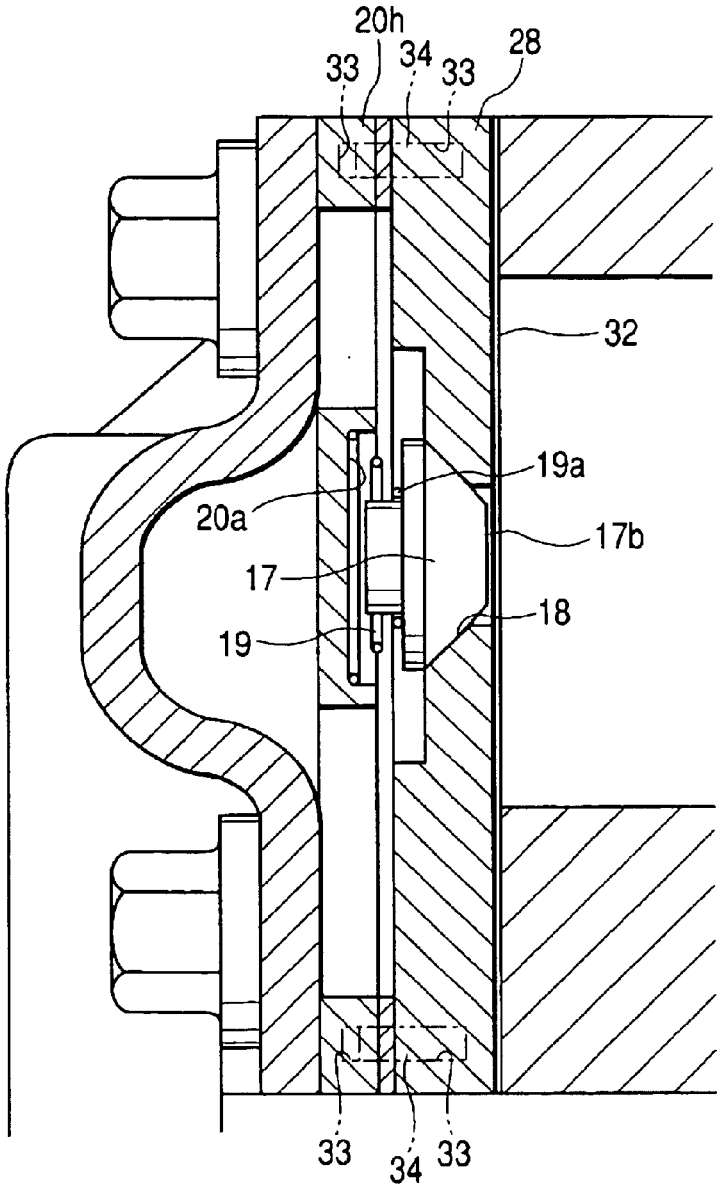
FIG. 22 is an enlarged view of the discharge valve of the compressor shown in the FIG. 21.

FIG. 21 is the vertical cross-section view for showing the structure of a so-called Scotch yoke type reciprocating compressor having the discharge valve according to the embodiment mentioned above. FIG. 22 is the cross-section view for showing the compressor shown in the FIG. 21, in particular in the vicinity of the discharge valve thereof, enlargedly. The compression element 3*a* of the Scotch yoke type reciprocating compressor comprises a cylinder block 25, a frame on which the cylinder block 25 is fixed, a piston 27 which is inserted into a bore portion 25*a* of the cylinder block 25, and a cylinder head which closes one opening of the cylinder block 25. Onto a cylinder head 28 is attached a retainer 20*h*, on which the coiled spring 19 is attached, and on the retainer 20*h* is attached a head cover 29 forming the discharge chamber 16 therewith. It also comprises a slider 30 which is engaged with an eccentric portion 7*c* of a crank shaft 7*b*. And, the discharge valve 13 according to the present embodiment of the present invention mentioned above is provided on a cylinder head 28.

Compression operation of the Scotch yoke type reciprocating compressor is performed as follows. When electricity is conducted through the electromotive element 2*c*, rotation of the rotor 2*b* drives the crank shaft 7*b*, and the piston 27 conducts reciprocating movement within the bore portion 25*a*, following the revolution of the slider 30 accompanying therewith, thereby repeating increase and decrease in volume of the operation chamber 21. Accompanying with the reciprocating movement of this piston 27, the working fluid (the refrigerant) sucked into from the suction pipe 11 flows into a silencer 31, and after passing through the suction valve 32 of a thin plate, it is compressed within the above-mentioned operation chamber 21. Next, the working fluid compressed passes from the discharge port 14 through the discharge valve 13 into the discharge chamber 16, and is discharged outside the compressor from the discharge pipe 12.

Herein, the retainer 20*h* and the coiled spring 19 and the valve 17 are assembled in one body, in such the method as shown in those FIGS. 5 to 7. The retainer 20*h* mentioned above is positioned with respect to the cylinder head 28, so that the valve 17 mentioned above and the valve seat 18 are concentric with each other, through guide pins 34, which are inserted into the guide bores 33 provided on the retainer 20*h* and the cylinder head 28 at least two (2) or more with keeping a fine clearance of about 50 $\mu$m therebetween.

With this, the discharge valve can be assembled easily, as well as the valve 17 and the valve seat 18 in almost concentric with, and the valve can be protected from the inclination thereof when it is seated, thereby suppressing the delay in closing thereof. Also, an escape portion is provided with a flat surface portion on the bottom of the bottom surface 17*b* of the valve 17, so that the valve 17 does not project into the operation chamber of the bore portion 25*a* when it is inclined, therefore it is possible to reduce the clearance volume comparing to the case where the escaping portion for the valve 17 is provided at the top of the piston 27.

From the above, since the reciprocating compressor of the present embodiment has the discharge valve 13 according to the present embodiment, it is possible to reduce the suction volume due to the re-expansion of the gas within the clearance volume of the discharge port, thereby to improve the volume efficiency thereof. It is also possible to improve the assembling workability and productivity of the compressor, or improve the sealing property of the valve, thereby to improve the adiabatic efficiency of the compressor.

In the embodiments mentioned above, the explanation was given only on the case where the discharge valve is applied to the oscillating piston compressor and the reciprocating compressor, however the present invention should not be restricted only thereto, but it may be applied to a scroll compressor, with obtaining the following effects therefrom.

With the scroll compressor having the discharge valve 13 according to the present invention, shortage compression loss is small even when the design pressure ratio (being proportional to the turn number of wrap winding) of wrapping is made smaller than the operating pressure ratio, therefore it is possible to remove the re-expansion loss caused due to the clearance volume of the discharge port. Accordingly, it is possible to reduce the turn number of the wrap winding, greatly, thereby greatly reducing the manufacturing steps, as well as improving the assembling workability thereof; therefore it is possible to provide the compressor being greatly reduced in the manufacturing const thereof. Then, the scroll having pressure ratio of about four (4) for use in the air-conditioning also can be used as the scroll for use in the refrigerator of the pressure ratio, being as two times large as that, i.e., with high efficiency. It is possible to achieve common use of the parts between both of them, thereby realizing great cost reduction thereof. It is also possible to improve the assembling workability and the productivity of the compressor, thereby providing the compressor having improvement on the sealing property between the valve and the valve seat.

As was fully explained in the above, according to the present invention, it is possible to provide the compressor, being easy in assembling and improved in the performances thereof.

While we have shown and described several embodiments in accordance with our invention, it should be understood that the disclosed embodiments are susceptible of changes and modifications without departing from the scope of the invention. Therefore, we do not intend to be bound by the details shown and described herein but intend to cover all such changes and modifications falling within the ambit of the appended claims.

What is claimed is:

1. A compressor, comprising:

a compression chamber including a cylinder and a piston for compressing working fluid therebetween;

an end plate for blocking an opening of the cylinder, the end plate including a discharge port provided therethrough, through which the working fluid flows out from the compression chamber, the end plate having a valve seat portion and a bore connected to the valve seat portion;

the valve seat portion provided around the discharge port and having a tapered surface, so that a cross-sectional area of the discharge port increases in a direction away from the compression chamber;

a valve having a projection portion having a tapered surface, at least a portion of which, in a closed portion is in contact with the tapered surface of the valve seat portion wherein the valve has a flat surface portion provided at an end portion of the valve on the side of the compression chamber;

a retainer inserted into the bore for holding the valve opposing to the valve seat portion; and a biasing means for supporting the valve, so that the valve is biased towards the closed position in contact with the tapered surface of said valve seat portion by can be forced out of contact with the tapered surface of the valve seat portion by pressure within the compression chamber, wherein the biasing means is a leaf spring formed with slits for biasing the valve with a central portion thereof.

2. A compressor as defined in claim 1, wherein the retainer through which the working fluid is discharged includes an opening.

3. A compressor as defined in claim 1, wherein the discharge port has a cylindrical portion provided between the compression chamber and the discharge port with said valve seat portion.

4. A compressor as defined in claim 1, further comprising a passage provided between the retainer and an inner side surface of the bore for conducting the working fluid therethrough.

5. A compressor as defined in claim 1, wherein the valve seat portion end the bore are coaxial.

6. A compressor comprising:

a compression chamber including a cylinder and a piston for compressing working fluid therebetween;

an end plate for blocking an opening of the cylinder, the end plate including a discharge port provided therethrough, through which the working fluid flows out from the compression chamber, the end plate having a valve seat portion and a bore connected to the valve seat portion;

the valve seat portion provided around the discharge port and having a tapered surface, so that a cross-sectional area of the discharge port increases in a direction away from the compression chamber; and a valve having a projection portion having a tapered surface, at least a portion of which, in a closed portion is in contact with the tapered surface of the valve seat portion wherein the valve has a flat surface portion provided at an end portion of the valve on the side of the compression chamber;

wherein the tapered surface of the projection portion of said valve has a conical portion at an end closest to said compression chamber and another portion adjacent the conical portion having the shape of a segment of a sphere, wherein, in a dosed position, a portion of the another portion contacts a portion of the tapered surface of said valve seat portion to form the line contact between said valve and said valve seat portion.

7. A compressor, as defined in claim 6, further comprising:

a biasing means for supporting the valve, so that the valve is biased towards the closed position in contact with the tapered surface of said valve seat portion but can be forced out of contact with the tapered surface of the valve seat portion by pressure within the compression chamber.

8. A compressor, as defined in claim 7, wherein biasing means is a coiled spring engaged with the valve, the coiled spring being formed nearly into a conical shape.

9. A compressor as defined in claim 6, wherein the tapered surface of the valve seat portion has a conical shape.

10. A compressor as defined in claim 6, wherein the retainer through which the working fluid is discharged includes an opening.

11. A compressor as defined in claim 6, wherein the discharge port has a cylindrical portion provided between the compression chamber and the discharge port with said valve seat portion.

12. A compressor as defined in claim 6, further comprising a passage provided between the retainer and an inner side surface of the bore for conducting the working fluid therethrough.

13. A compressor as defined in claim 6, wherein the valve Seat portion and the bore are coaxial.

* * * * *